US009472876B1

(12) United States Patent
Hoffmeyer

(10) Patent No.: US 9,472,876 B1
(45) Date of Patent: Oct. 18, 2016

(54) EYE-OF-NEEDLE COMPLIANT PIN

(71) Applicant: International Business Machines Corporation, Armonk, NY (US)

(72) Inventor: Mark K. Hoffmeyer, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 14/867,035

(22) Filed: Sep. 28, 2015

(51) Int. Cl.

| | |
|---|---|
| ***H01R 13/42*** | (2006.01) |
| ***H01R 12/71*** | (2011.01) |
| ***H01R 25/00*** | (2006.01) |
| ***H01R 43/20*** | (2006.01) |

(52) U.S. Cl.
CPC ..... *H01R 12/71* (2013.01); *H01R 25/00* (2013.01); *H01R 43/205* (2013.01)

(58) Field of Classification Search
CPC .... H01R 12/71; H01R 43/205; H01R 25/00; H01R 12/7064
USPC ..... 439/638, 751, 816
See application file for complete search history.

(56) References Cited

U.S. PATENT DOCUMENTS

| | | | | |
|---|---|---|---|---|
| 4,655,537 | A * | 4/1987 | Andrews, Jr. ..... | H01R 12/585 439/751 |
| 7,249,981 | B2 | 7/2007 | Chen | |
| 2006/0274483 | A1 | 12/2006 | Porter et al. | |
| 2007/0081311 | A1 | 4/2007 | Iwamiya et al. | |
| 2008/0166928 | A1 | 7/2008 | Tang | |
| 2013/0337697 | A1 | 12/2013 | Buschel et al. | |
| 2014/0273639 | A1 | 9/2014 | Larsen et al. | |

FOREIGN PATENT DOCUMENTS

| | | | |
|---|---|---|---|
| EP | 2518117 | A1 | 10/2012 |
| WO | 2013165649 | A1 | 11/2013 |
| WO | 2014058577 | A1 | 4/2014 |

OTHER PUBLICATIONS

Goodman et al., "Technical adaptation under Directive 2002/95/EC (RoHS)—Investigation of exemptions", ERA Report 2004-0603, Dec. 2004, pp. 1-79, Copyright ERA Technology Limited 2004.
Hoffmeyer, M., "Twisted Eye-Of-Needle Compliant Pin", U.S. Appl. No. 14/867,037, filed Sep. 28, 2015.
List of IBM Patents or Patent Applications Treated as Related, Sep. 25, 2015, 2 pages.

* cited by examiner

*Primary Examiner* — Javaid Nasri
(74) *Attorney, Agent, or Firm* — Robert C. Bunker

(57) ABSTRACT

A first connector includes a first plurality of eye-of-needle (EON) pins. Each EON pin of the first plurality includes two opposing spring arms. Each EON pin of the first plurality is configured to be received within a corresponding electrical via of a printed circuit board (PCB) such that the spring arms engage walls of the corresponding electrical via at a set of contact points. A second connector includes a second plurality of EON pins. Each EON pin of the second plurality includes two opposing spring arms. Each EON pin of the second plurality is configured to be received within a same corresponding electrical via of the PCB as a corresponding EON pin of the first plurality located at a same relative connector body location such that the spring arms engage the walls of the same corresponding electrical via at a different set of contact points.

13 Claims, 5 Drawing Sheets

New Via Before Compliant Pin Insertion

After Compliant Pin Insertion

After Compliant Pin Removal

After Compliant Pin Rework

EYE-OF-NEEDLE COMPLIANT PIN

BACKGROUND

The present disclosure relates to electrical connectors, and more specifically, to electrical connectors secured to electrical vias by resiliently gripping conductive material of the vias.

An electrical connector is an electro-mechanical device for joining electrical circuits at an interface using a mechanical assembly. Each connector can comprise a mating segment. The mating segment can include a header segment (male-ended) or a receptacle segment (female-ended). The electrical connectors can be grouped together in a set of one or more within a single connector body. The connector body can be configured to house electrical connectors that include header segments, receptacle segments, or both. The electrical connectors can be inserted into a device, such as a printed circuit board that includes electrical vias in order to maintain an electrical connection between the printed circuit board and another electrical device. The electrical connection may be temporary (as for portable equipment), require a tool for assembly and removal, or serve as a permanent electrical joint between two wires or devices. There are hundreds of types of electrical connectors. Electrical connectors can include compliant pins, and more specifically eye-of-needle (EON) compliant pins.

SUMMARY

According to embodiments of the present disclosure, aspects of the present disclosure are directed towards a kit. The kit can include a first connector including a first plurality of eye-of-needle (EON) pins inserted into a first connector body. Each EON pin of the first plurality of EON pins can include a compliant segment that can comprise two opposing spring arms and an opening defined between the spring arms. Each compliant segment of the first plurality of EON pins can be configured to be received within a corresponding electrical via of a printed circuit board (PCB) such that the spring arms of each EON pin of the first plurality of EON pins can engage walls of the corresponding electrical via at a set of contact points. The kit can further include a second connector. The second connector can include a second plurality of EON pins inserted into a second connector body. Each EON pin of the second plurality of EON pins can have a compliant segment that can comprise two opposing spring arms and an opening defined between the spring arms. Each compliant segment of the second plurality of EON pins can be configured to be received within a same corresponding electrical via of the PCB as a corresponding EON pin from the first plurality of EON pins located at a same relative connector body location such that the spring arms of each EON pin of the second plurality of EON pins can engage the walls of the same corresponding electrical via at a different set of contact points.

According to embodiments of the present disclosure, aspects of the present disclosure are directed towards a method. The method can include identifying a first connector connected to a printed circuit board (PCB). The first connector can include a first plurality of eye-of-needle (EON) pins inserted into a first connector body. Each EON pin of the first plurality of EON pins can have a compliant segment that comprises two opposing spring arms and an opening defined between the spring arms. Each compliant segment of the first plurality of EON pins can be residing within a corresponding electrical via of the PCB such that the spring arms of each EON pin of the first plurality of EON pins are engaging walls of the corresponding electrical via at a set of contact points. The method can further include disconnecting the first connector from the PCB. The method can further include inserting a second connector into the PCB after disconnecting the first connector from the PCB. The second connector can include a second plurality of EON pins inserted into a second connector body. Each EON pin of the second plurality of EON pins can have a compliant segment comprising two opposing spring arms and an opening defined between the spring arms. Each compliant segment of the second plurality of EON pins can be received within a same corresponding electrical via of the PCB as a corresponding EON pin from the first plurality of EON pins located at a same relative connector body location such that the spring arms of each EON pin of the second plurality of EON pins are engaging the walls of the same corresponding electrical via at a different set of contact points.

The above summary is not intended to describe each illustrated embodiment or every implementation of the present disclosure.

BRIEF DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1A:
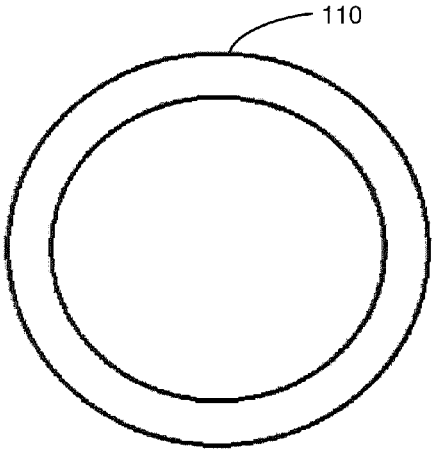
FIG. 1A, FIG. 1B, FIG. 1C, and FIG. 1D depict cross sectional views of contact points between one or more compliant pins and an electrical via during a reworking process, according to embodiments of the present disclosure.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

Aspects of the present disclosure relate to electrical connectors, more particular aspects relate to the electrical connectors secured to electrical vias by resiliently gripping conductive material of the vias. While the present disclosure is not necessarily limited to such applications, various aspects of the disclosure may be appreciated through a discussion of various examples using this context.

Eye-of-needle (EON) compliant pin connectors are commonly used in high performance computing systems as they can have numerous assembly process advantages. These advantages may include the ability to circumvent a need for use of high stress soldering operations involving solder compositions. This can be an important advantage in high component density, thick, high-layer-count printed circuit boards (PCBs), where large surface mount connectors or pin-in-hole solder tail connectors cannot be processed effectively due to the high thermal mass of the complex constructions without specialized tools, fixtures, and selective solder reflow processes.

In recent years, the menu of available EON compliant pin connectors has expanded to accommodate increasing demands for a higher density of connections within a given amount of electronic packaging space. As a result, compliant pin connectors are now available in a number of reduced pitches and pin sizes, and terms like "standard", "mini", and "micro" compliant pin technology are used to describe the different compliant pin connector types. Obviously, since these connector types vary in EON compliant pin size, each of these connector types can require use of a different finished printed circuit board's electrical via size and array size to match the pin size, as specified by the connector supplier. This can lead to a decrease in the likelihood of a good electrical contact when the EON compliant pins are inserted into electrical vias and also decrease the likelihood of long term reliability within an assembled application.

Manufacturers of EON compliant pins and manufacturers of printed circuit boards sometimes have different size standards and are not in communication when developing a size for their instruments. Without careful control of the dimension of a hole of the electrical via and plating parameters, printed circuit board (electrical via) damage can develop due to stresses resulting from EON compliant pin insertion and rework reinsertion steps. This damage can include but is not limited to electrical via cracks and interplane separation.

Of a possible greater importance, is the fact that even when boards are processed with optimal plated through hole characteristics (preferred plating thickness and recommended hole diameters), rework operations can drive the creation of defects because of general hardware tolerances, and because of the fact that, during reworking, compliant pins can scour over common deformed barrel areas created upon initial connector insertions. These conditions can lead to either card damage or insufficient EON compliant pin retention force within the printed circuit board.

On complex printed circuit boards, the rework of EON compliant pin connectors can be very common (specifically their removal followed by reinsertion of new EON compliant pins) and can poses additional challenges to avoid electrical circuit board damage, latent reliability issues, or yield loss. In these situations, a common region within a through hole barrel can be subjected to high stresses during EON compliant pin insertion. In addition, complex printed circuit boards can also possess various attributes and process challenges that do not necessarily allow for compliant pin plated through holes to be manufactured with optimal plating thicknesses or hole diameters. These limitations can create a narrow margin for rework success and reliability assurance, and in general multiple insertion reworks may not be allowed.

Turning to FIG. 1A, a cross-sectional view of an electrical via 110 prior to insertion of an EON compliant pin can be seen, according to various embodiments. The electrical via 110 can include various conducting metals that can carry an electrical signal from the EON pin to the electrical via. For example, the electrical via can be a material, such as copper, aluminum, gold, or silver. The electrical via can be in an array that includes a plurality of electrical vias within a printed circuit board.

When providing hole plating compensation processes to accommodate overall functional reliability of electrical vias, the electrical vias can become exceedingly small. In many instances finished hole sizes for some electrical vias end up at upper specification limits for functionality and reliability. This can lead to electrical vias that may not match up with EON compliant pins. When this scenario results, an ability to assemble or rework reliably with EON compliant pin connections can become compromised, sometimes resulting in the scrapping of printed circuit board assemblies. Several problems can drive this yield loss, including electrical conduction loss from an EON compliant pin.

Other problems can occur during reworking. Rework problems can include insufficient normal force and retention forces for compliant pin reinsertions to ensure contact reliability. More specifically, during reworking, a diameter size of an electrical via can become too large in the local insertion region to support adequate normal force and stored energy of opposing spring arms of an EON pin. This can happen because the reinserted pin must traverse across previously deformed material in the electrical via, which effectively can create hole diameters that are too large. In other situations, in particular when compliant pin plated through holes are at the low end of specification for diameter and plating thickness, board damage upon initial insertion or rework reinsertion can result. Types of damage can include, for example, electrical cracks or laminate printed circuit board inter-plane separation.

Figure 1B:
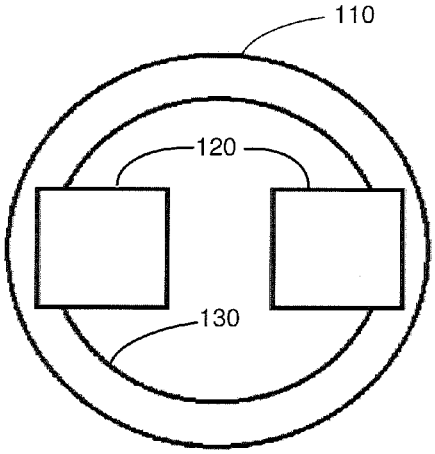

In FIG. 1B, a cross-sectional view of a pair of opposing spring arms 120 of an EON pin extending outward against an inner surface 130 of the electrical via 110 can be seen, according to embodiments. A normal force exerted by the opposing spring arms 120 upon the inner surface 130 can cause a portion of the electrical via 110 to compress. This compressing of the material can, in some cases, cause damage to the material and consequently to the electrical conducting properties of the electrical via 110. This damage can affect the flow of electricity from the EON compliant pin to the printed circuit board and thus can affect electrical components that are used in conjunction with the printed circuit board. The normal force can depend on the size of the EON pin and the diameter of the inner surface 130 of the electrical via 110. The normal force can be necessary in order to keep the EON pin in place within the electrical via, so that movement of the EON pin within the electrical via can be decreased.

When using EON compliant pin connector technologies that possess different interconnect pitches and reduced pin sizes on complex electric circuit board cross sections, various challenges can emerge that can impact potential post assembly connector reliability. Specifically, on complex boards that possess high aspect ratio plated thru holes, it can be very difficult for an electric circuit board supplier to fine tune electrical via operations to accommodate a number of compliant pin sizes reliably and effectively with tight tolerance controls.

In effect, the above challenges can drive a need for printed circuit board suppliers to use different drill hole sizes and plating thickness ranges that depart from parameters that are typically specified and qualified by the EON compliant pin connector vendors in order to provide boards with final holes sizes that are within the specified target ranges. These adjustments can drive a very careful balancing act that can require electric wiring board vendors to couple drill hole size adjustments with multiple copper electrolytic plating bath plating process adjustments to increase the likelihood of proper finished electrical via sizes that could support reliable EON compliant pin connector insertion and adequate plating thickness on most electrical vias of all sizes for long term reliability.

Figure 1C:
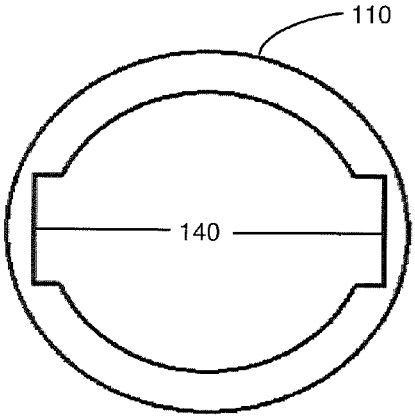

In FIG. 1C, a cross-sectional view of an electrical via 110 after removal of an EON pin from the electrical via 110 can be seen, according to embodiments. In embodiments, indentations 140 in the electrical via 110 caused by the opposing spring arms 120 exerting an outward force can be seen. Removing the EON pin from the electrical via could be due to routine maintenance. Removing the EON pin from the electrical via 110 could cause damage to the electrical via 110, or the normal force exerted by the opposing spring arms 120 could cause damage. Damage can also be caused by reinserting the same or a substantially similar EON pin into the electrical via 110, such that upon reinsertion the EON pin is in contact with the indentations 140.

In some embodiments, it may be helpful to create a second EON pin that compliments the first EON pin such that when the second EON pin is inserted, this can result in the second EON pin engaging the inner surface 130 of the electrical via 110 at a different set of contact points (e.g., contact points not in the indentations 140). This can reduce the damage to the electrical via caused during reworking.

To increase the likelihood of reliable rework and extended reworkablility of EON compliant pin connectors, a second EON pin may be introduced into the electrical via 110. In some embodiments, the second EON pin can create different contact orientations of the EON compliant pin within the electrical via upon reinsertion than the set of contact points. Having this different set of contact points within the electrical via 110 can, in some embodiments, increase the likelihood of uniform insertion and consistent insertion force, as well as minimize impact for excessive inner surface 130 deformation that could lead to damage of the printed circuit board.

Figure 1D:
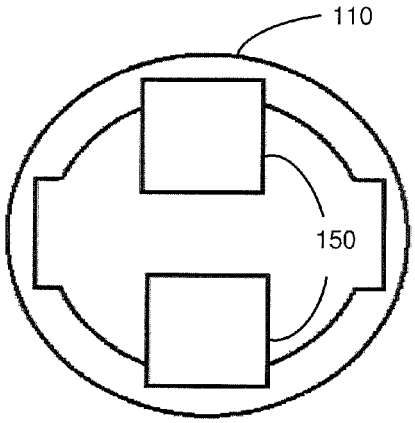

Now turning to FIG. 1D, a cross-sectional view of a second pair of opposing spring arms 150 that are rotated substantially orthogonal to the pair of opposing spring arms 120 within the electrical via 110 can be seen, according to embodiments. This orthogonal rotation could be due to an introduction of the second EON compliant pin within the electrical via 110. In embodiments, the second pair of opposing spring arms 150 can a rotated version of the pair of opposing spring arms 120. The second EON can be rotated within a connector body orthogonally with respect to the first EON compliant pin in another connector body. This can result in the second pair of opposing spring arms 150 engaging the inner surface 130 of the electrical via 110 at a different set of contact points. The contact of the second pair of opposing spring arms 150 with the different set of contact points of the electrical via 110 could reduce the likelihood of damaging the electrical via 110 during reworking.

A third EON pin (not shown) could be inserted after removal of the second EON pin. This third EON pin could include a rotation with respect to the different set of contact points such that, when inserted, the spring arms engage the inner surface 130 of the electrical at yet another set of new contact points of the electrical via. For example, the rotation could be thirty degrees, forty-five degrees, or sixty degrees with respect to the indentations 140. This reworking process could continue with each subsequent EON pin containing a rotation within a connector body such that each subsequent EON pin engages the inner surface 130 of the electrical via 110 at a plurality of different sets of contact points.

Figure 2B:
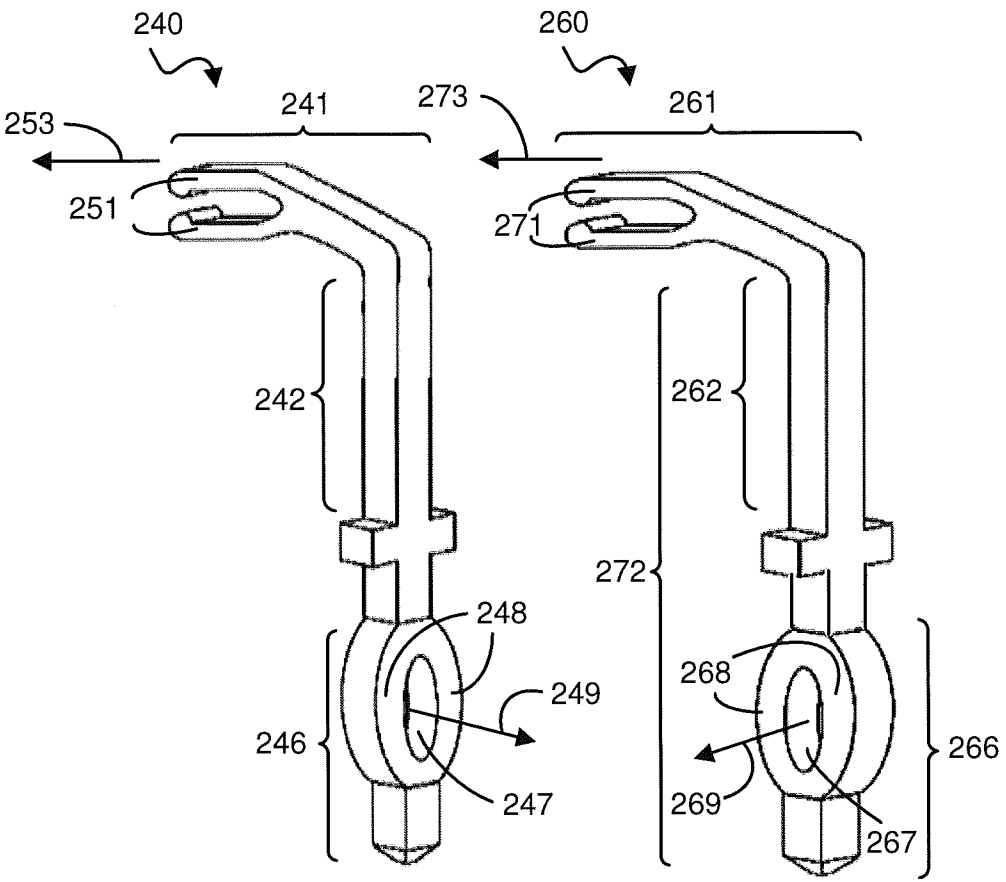
FIG. 2B depict a first female eye-of-needle (EON) compliant pin and a second female EON compliant pin that includes a compliant segment that is rotated ninety degrees with respect to the complaint segment of the first female EON complaint pin, according to embodiments of the present disclosure.
Figure 2A:
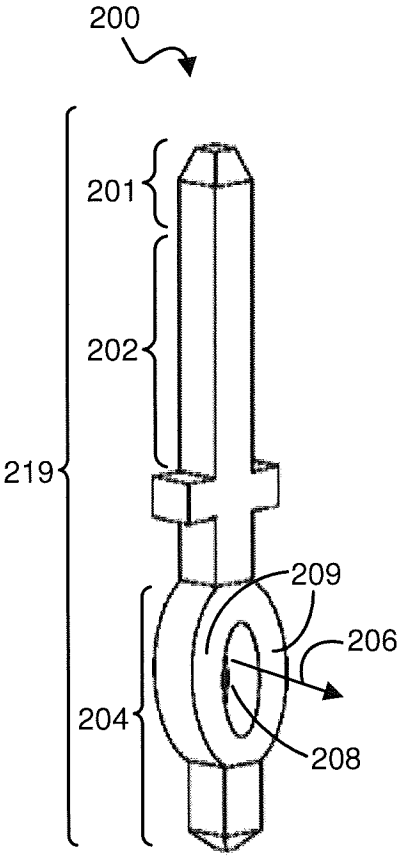
FIG. 2A depicts a male eye-of-needle (EON) compliant pin that includes a header segment, according to embodiments of the present disclosure.

Turning now to FIG. 2A, in embodiments, a male EON compliant pin 200 can be seen, according to embodiments. In embodiments, the male EON compliant pin 200 can include a header segment 201 configured for insertion within a receptacle segment of a female EON compliant pin. The male EON compliant pin 200 can also include a length segment 202. In embodiments, the male EON compliant pin can 200 can include a compliant segment 204. In embodiments, the compliant segment 204 and the length segment 202 can together form a substantially straight solid body 219. The compliant segment 204 can include two opposing spring arms 209. The two opposing spring arms 209 can define a substantially planar opening 208. In some embodiments, the header segment 201 can be bent at a mating angle relative to the length segment 202. In embodiments, the mating angle can be, but is not limited to, a substantially right angle, or can be at an angle between ninety degrees and zero degrees. In some embodiments, male EON compliant pin 200 could have a substantially straight header segment 201.

Turning now to FIG. 2B, a first female EON compliant pin 240 and a second female EON compliant pin 260 that includes a second compliant segment 266 rotated ninety degrees with respect to a compliant segment 246 of the female EON compliant pin 240 can be seen, according to embodiments. In embodiments, the female EON compliant pin 240 can include a receptacle segment 241 that can include a pair of resiliently deflectable fingers 251. The pair of resiliently deflectable fingers 251 can be spaced apart a distance and can be configured for accepting a header segment, such as the header segment 201. The header segment 201 can create a force by displacing each of the resiliently deflectable fingers 251 that can increase a frictional force. The increased frictional force between the header segment 201 and the resiliently deflectable fingers 251 can increase the likelihood that the header segment 201 can stay in place within the resiliently deflectable fingers 251. In use, an electrical current can flow from the header segment 201 to the receptacle segment 241 or vice versa. The female EON compliant pin 240 can also include a length segment 242. The compliant segment 246 can include two opposing spring arms 248. The two opposing spring arms 248 can define a second substantially planar opening 247. A normal 249 of the second substantially planar opening 247 can project outward from the second substantially planar opening 247 and perpendicularly to the second substantially planar opening 247.

The second female EON compliant pin 260 can include a receptacle segment 261 that can include a pair of resiliently deflectable fingers 271. The pair of resiliently deflectable fingers 271 can be configured for accepting header segments, such as the header segment 201. The female EON compliant pin 260 can also include a length segment 262. The second female EON compliant pin 260 can further include a compliant segment 266 that includes two opposing spring arms 268. The two opposing spring arms 268 can define a third substantially planar opening 267. A second normal 269 of the third substantially planar opening 267 can project outward from the third substantially planar opening 267 and perpendicularly to the third substantially planar opening 267, such that an angle between the first normal 249 and the second normal 269 is substantially ninety degrees. In embodiments, the angle between the first normal 249 and the second normal 269 can include degrees between thirty degrees and one-hundred fifty degrees, e.g., thirty degrees, forty-five degrees, and sixty degrees. The EON compliant pins 240, 260 can include a direction that the mating segment is facing 253, 273. For example, the mating segment of a male and female EON compliant pin, e.g. the header segment 201 and the receptacle segments 241, 261 can face a same direction. In embodiments, the angle between the first normal 249 and the second normal 269 can be taken with respect to the direction that the mating segment is facing 253, 273 when the directions are facing in a substantially similar direction. The direction that the mating segment is facing can be the direction that the mating segment is inserted within a PCB or the direction of mating with an EON compliant pin. In embodiments, the compliant segment 266 and the length segment 262 can together form a substantially straight solid body 272. The receptacle segment 261 or 241 can be bent at a first mating angle relative to the length segment 262 or 242. In embodiments, the second mating angle can be, but is not limited to, a substantially right angle, or can be at an angle between ninety degrees and zero degrees. In some embodiments, female EON compliant pins 260 or 240 could have a substantially straight receptacle segment 261 or 241.

In order to increase the likelihood of reliable reworking and to extend the lifetime of a PCB, a kit can be used for reworking. The kit can include a first connector and a second connector. The first connector can include a first plurality of EON compliant pins housed within a first connector body. The first plurality of EON compliant pins could be male EON compliant pins or female EON compliant pins as described in FIG. 2A and FIG. 2B, respectively. The first plurality of EON compliant pins can engage walls of an electrical via at a set of contact points. The second plurality of EON compliant pins can engage walls of an electrical via at a different set of contact points. A second connector body can include a second plurality of EON compliant pins housed within a second connector body. The second plurality of EON pins could be male EON compliant pins or female EON compliant pins. The first connector body and the second connector body can be substantially similar. The second plurality of EON compliant pins can be located at a same relative location within the second connector body as the first plurality of EON compliant pins are located within the first connector body. The second plurality of EON compliant pins can be rotated with respect to the first plurality of EON compliant pins such that spring arms of each EON compliant pin of the second plurality of EON pins can engage the walls of the same electrical via that each corresponding EON compliant pin of the first plurality pin previously engaged but at a different set of contact points. The first and second plurality of EON compliant pins can be designed within their respective connector bodies such that they can be orthogonal to one another with respect to the set of contact points and different set of contact points. The first and second plurality of EON pins can also be designed at, e.g. thirty degrees, forty-five degrees, sixty degrees, or any degree between thirty and one hundred fifty degrees. This can increase the likelihood of maintaining compatibility of the spring arms engaging walls of an electrical via. This can also increase a balance of negligible differences in electrical contact performance characteristics between manufacturing specifications of an EON compliant pin and an electrical via.

EON compliant pins can be housed within a connector body. A connector body can group multiple male EON compliant pins together or multiple female EON complaint pins together or a mixed group. Turning now to FIG. 3A, a first connector 300 after removal from a printed circuit board 303 can be seen, according to embodiments of the present disclosure. This connector could be a first connector in a set of two connectors included in a kit that could be used for reworking. The first connector 300 can include a connector body 301 housing a plurality of male compliant pins 200. The connector body 301 can include an opening that can accept a receptacle segment, e.g. receptacle segment 241, to connect with the header segment 201 of each male EON compliant pin 200. The connector body 301 can house one or more EON compliant pins 200 in a square or rectangular array. The combination of a plurality of compliant pins 200 and the connector body 301 can be used in conjunction with the printed circuit board 303. Each of the EON compliant pins 200 can be inserted into an electrical via 302. In some embodiments, the printed circuit board 303 can include more electrical vias 302 than EON compliant pins 200 within the connector body 301. The printed circuit board 303 can include one or more electrical vias 302. Each of the EON compliant pins 200 can be inserted within an electrical via 302.

In some circumstances, for example, when a connector body is damaged or during routine maintenance, reworking could occur. Reworking can refer to a removal of EON pins from a printed circuit board 303 and an insertion of new EON pins within the printed circuit board. Reworking can include replacing a first connector, such as the connector 300 FIG. 3A, with a second connector. This can be useful for reducing damage to electrical vias during reworking. The second connector can introduce a rotation of a second plurality of EON pins that can result in each EON pin touching a different set of contact points on the inner rim of the electrical via than what was touched during a prior insertion of a first plurality of EON pins.

Figure 3B:
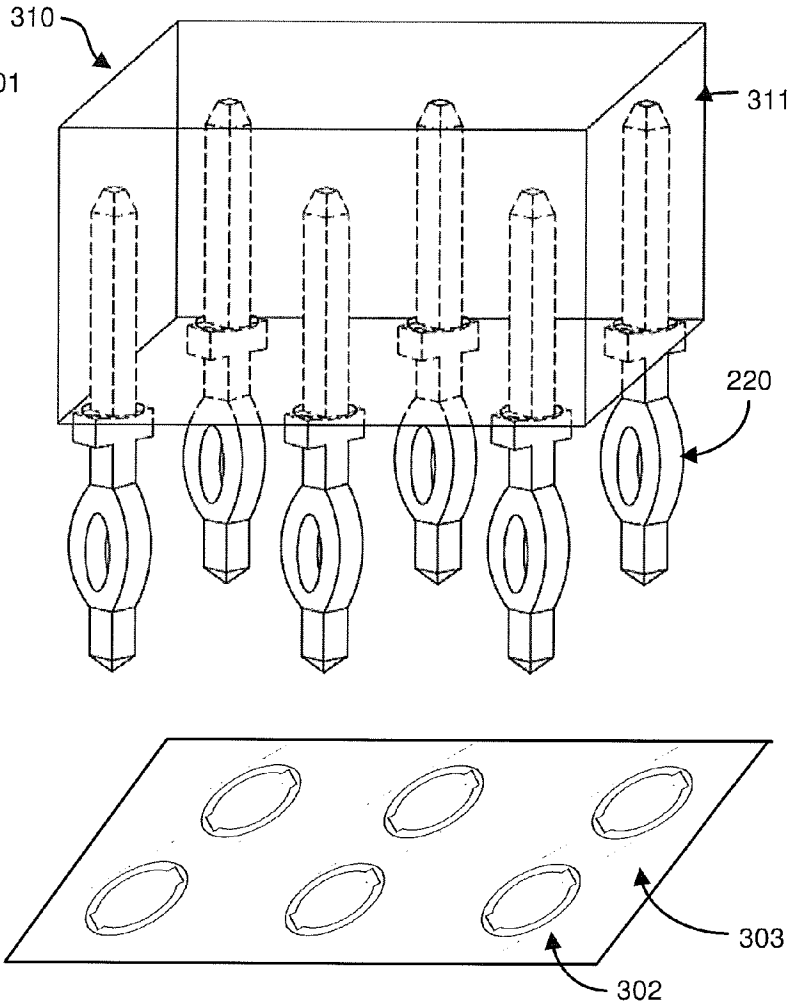
FIG. 3B depicts a second connector that includes a second plurality of male eye-of-needle (EON) compliant pins within a second connector body before being inserted into the printed circuit board containing the plurality of electrical vias, according to embodiments of the present disclosure.
Figure 3A:
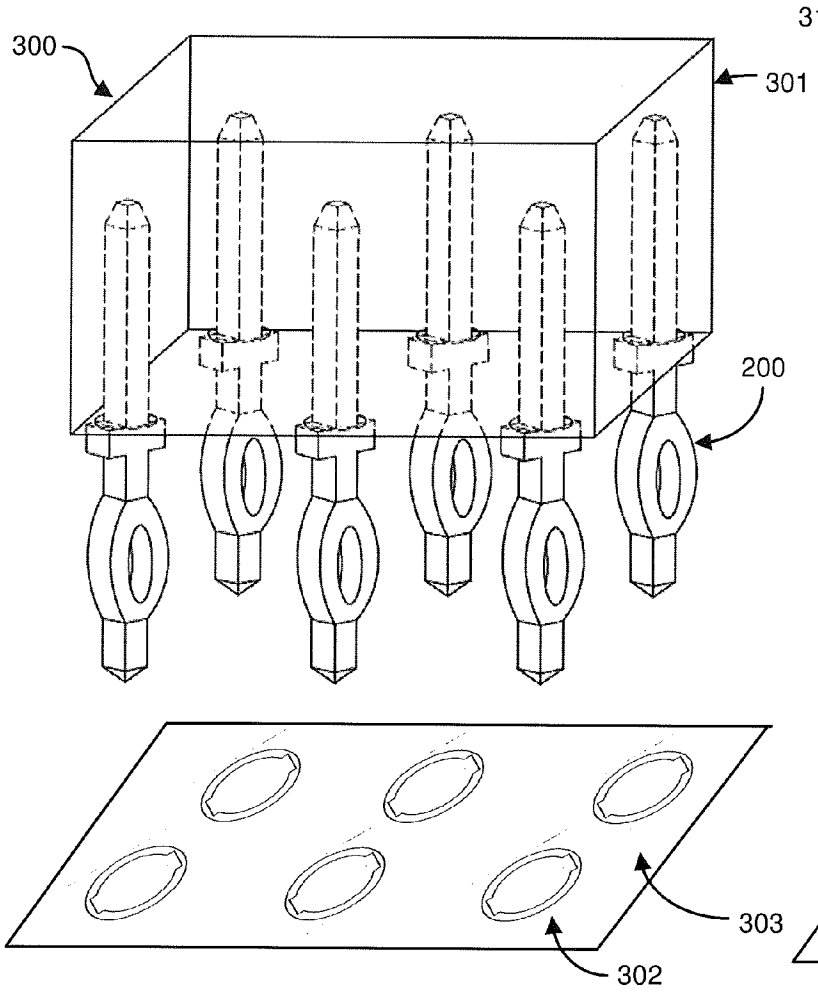
FIG. 3A depicts a first connector that includes a plurality of male eye-of-needle (EON) compliant pins within a connector body after being removed from a printed circuit board containing a plurality of electrical vias, according to embodiments of the present disclosure.

Turning now to FIG. 3B, a second connector 310 before insertion into a printed circuit board 303 can be seen, according to embodiments of the present disclosure. The second connector can be included in a kit that could be used for reworking. The second connector 310 can include a connector body 311 housing a second plurality of male compliant pins 220. This connector body could be the second connector body included in a kit. This second plurality of male EON complaint pins 220 can be inserted into the printed circuit board 303 after the removal of the plurality of EON pins 200 from the printed circuit board 303 (shown in FIG. 3A). The second plurality of EON compliant pins 220 can introduce a rotation between thirty degrees and one hundred fifty degrees to each EON pin in the plurality of EON pins with respect to a first plurality of EON pins that were removed from the PCB 303. The rotation can be determined after examination of the inner surface of the electrical vias following the removal of the plurality of EON complain pins 200 of the first connector 300.

Determining the rotation can be after examining the electrical vias 302 of the printed circuit board 303 after removal of a first connector, e.g. connector 300 during reworking, since the damage may not be consistent after every removal and the need for a different rotation may fluctuate. A person or instrument or combination thereof can examine the electrical via 302 and determine a needed rotation for reworking in order to choose a second connector. The second connector can include a second plurality of EON pins that can engage walls of an electrical via at a different set of contact points. This examining process can occur one or more times until most of the inner surface of the electrical via 302 has been in contact with one or more opposing spring arms. This reworking process using a kit that includes a first connector and a second connector could extend the life of a printed circuit board, hence saving resources. In either the first connector or the second connector, the pins may not all be aligned with each other, such that a column or row of EON pins may not form a straight line. Either connector 300 or 310 can also house female EON compliant pins that include a receptacle segment, such as female EON compliant pins 240 and 260 as described in FIG. 2B. An EON compliant pin from the first connector body can have a corresponding EON pin from the second connector body. The EON compliant pin and the corresponding EON pin could have the same relative connector body location. In embodiments, the EON compliant pin and the corresponding compliant pin can enter the same electrical via during reworking. In embodiments, the spring arms of the EON compliant pin can engage the walls of the electrical via at a set of contact points. Corresponding spring arms of the corresponding EON compliant pin can engage the walls of the same electrical via at a different set of contact points.

Figure 4B:
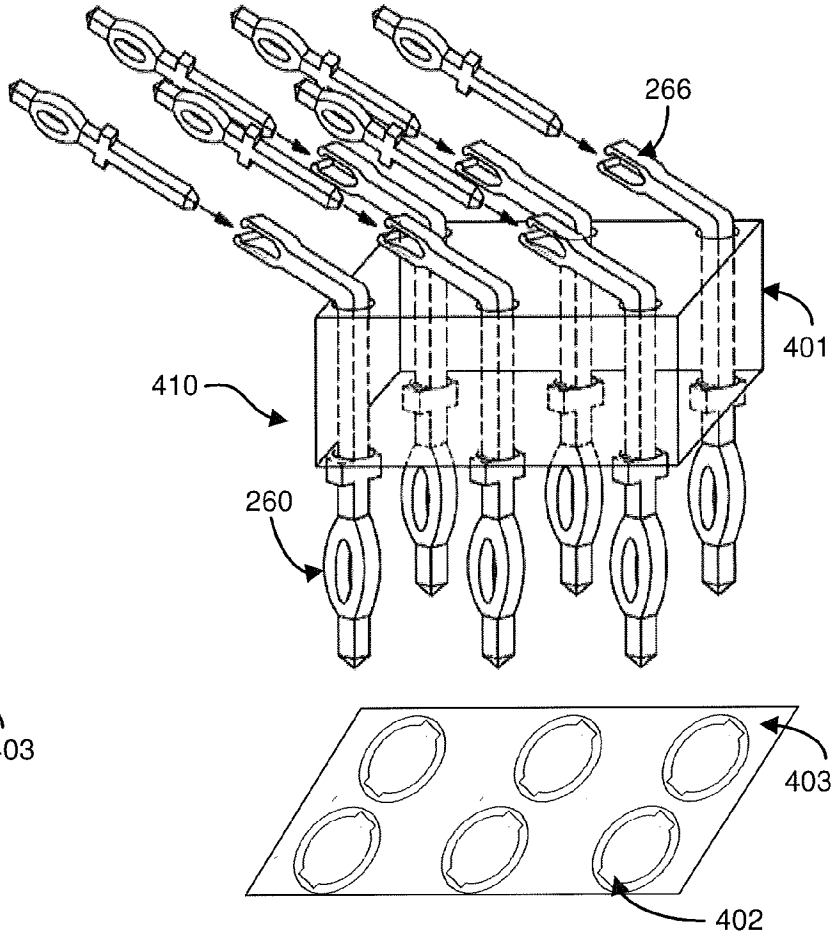
FIG. 4B depicts a second connector including a second plurality of female eye-of-needle compliant pins that include receptacle portions before being inserted within a printed circuit board, wherein each receptacle portion is shown mating with a header segment of a male (EON) compliant pin, according to embodiments of the present disclosure.
Figure 4A:
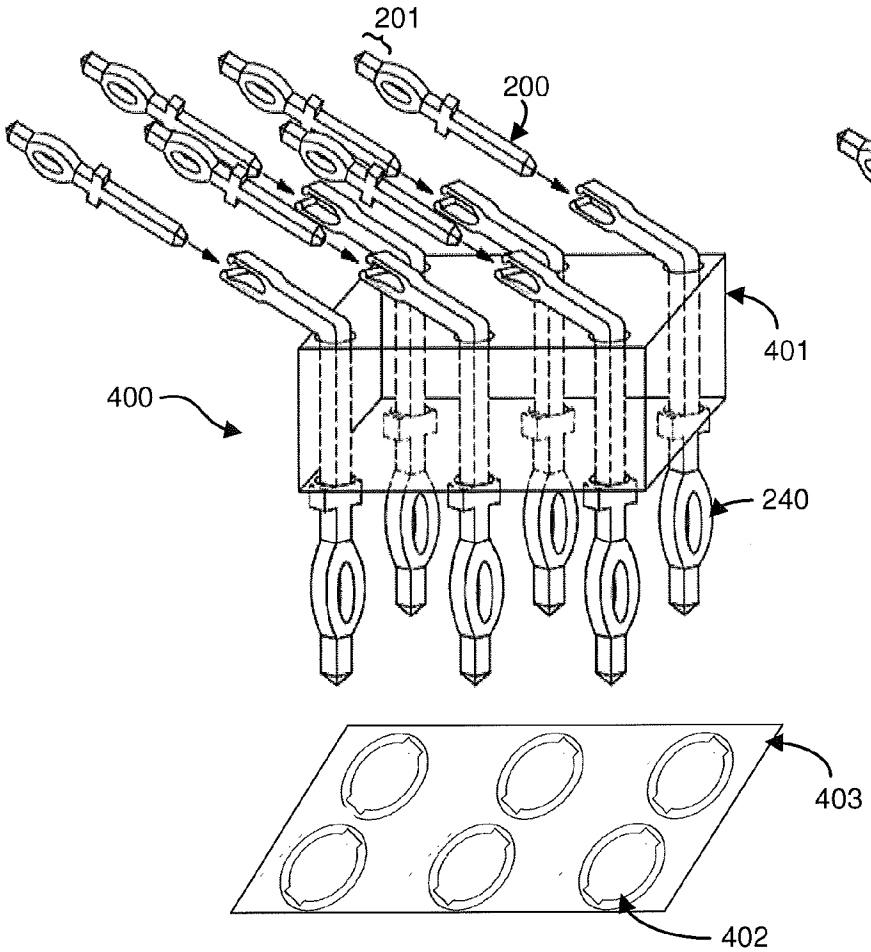
FIG. 4A depicts a first connector including a plurality of female eye-of-needle compliant pins that include receptacle portions after being removed from a printed circuit board, wherein each receptacle portion is shown mating with a header segment of a male (EON) compliant pin, according to embodiments of the present disclosure.

Turning now to FIG. 4A, a third connector 400 after removal from a printed circuit board (PCB) 403 can be seen, according to an embodiment of the present disclosure. The third connector can be included in a kit that could be used for reworking. In embodiments, the third connector 400 can include a connector body 401 housing a plurality of female compliant pins 240. The connector body 401 can include an opening that a receptacle segment 241 can protrude from that can accept a header segment, e.g., header segment 201, of the male EON compliant pin 200. The connector body 401 can house one or more female EON compliant pins 240 in a square or rectangular array. The combination of the plurality of female EON compliant pins 240 and the connector body 401 can be used in conjunction with the PCB 403. Each of the female EON compliant pins 240 can be inserted into an electrical via 402. The printed circuit board 403 can include one or more electrical vias 402. The printed circuit board 403 can include more electrical vias 402 than female EON compliant pins 240.

In some circumstances, for example, during routine maintenance, when a connector is damaged, e.g. the third connector 400 as described in FIG. 4A, or when some of a plurality of female EON compliant pins are damaged, reworking could occur. Removing this plurality of female EON compliant pins and inserting a second plurality of female EON pins could be difficult due to the receptacle segment. However, in embodiments, a kit that includes a fourth connector that can house a plurality of EON pins that can engage walls of electrical via and that are substantially similar to the EON compliant pin 260 as described in FIG. 2B.

In some embodiments, an angled mating section (e.g., receptacle or header) could cause issues during reworking. The angled mating section can be included in a male or female EON compliant pin. Note that the EON compliant pin including an angled mating section may, in some situations, not be rotatable within or removable from the connector body. This can make reworking difficult when a kit may not be involved. The angled mating segment can face the same way during every insertion. This can be the case when the mating segment is mated with an EON pin. When the mating segment is mated with an EON pin, it may be difficult to have EON compliant pins that hit at different contact points within the electrical via without fabricating the pin so that spring arms can engage the electrical via at a different set of contact points. An EON compliant pin that includes a bent mating segment can be fabricated so that the angled mating segment can face the same way during insertion as the EON compliant pin that was removed during reworking, and an opening defined between the spring arms of a compliant segment can be facing a different direction than the opening defined between the spring arms of the compliant segment of the removed complaint pin.

Turning now to FIG. 4B, a fourth connector 410 before insertion into an printed circuit board 403 can be seen, according to embodiments of the present disclosure. This fourth connector 410 can be included in a kit that could be used for reworking. In embodiments, the fourth connector 410 can include a connector body 402 housing a second plurality of female EON compliant pins 260. This second plurality of female EON compliant pins 260 can be inserted into the printed circuit board 403 after removing the plurality of female EON pins 240 from the printed circuit board 403. In embodiments, this compliant segments of the second plurality of female EON complaint pins 260 can be rotated with respect to the complaint segments of the first plurality of EON pins so that the spring arms engage walls of the electrical via at a difference set of contact points.

In some embodiments, the rotation can be between thirty degrees and one-hundred fifty degrees as described in FIG. 3A and FIG. 3B. For example, the new connector body 402 can include female EON compliant pins 260 that include rotations of thirty degrees, forty-five degrees, sixty degrees, or any degrees between thirty and one hundred fifty degrees. The rotation can be determined before inserting the fourth connector 410. The predetermined rotation can be determined after examining the electrical vias 402 subsequent to removal of the plurality of female EON complaint pins 240. In some embodiments, examination of the electrical vias 402 can be necessary since the damage may not be consistent after every removal and the need for a different rotation may fluctuate. A person or instrument or combination thereof can examine the electrical via 402 and determine the rotation needed for a new connector to be inserted during reworking. This examining process can occur one or more times until most of a surface of the inner rim of the electrical via 402 has been in contact with one or more opposing spring arms 266. This process could extend the life of the printed circuit board 403.

In embodiments, a second angled mating segment, e.g. the receptacle segment 261 of each EON pin of the second plurality of EON pins 260 can be mated with a corresponding EON pin, e.g. EON pin 200. The mating segment can include a header segment (male EON pins), e.g. 200, and a receptacle segment (female EON pins), e.g. 240, 260. Each of the EON pins from the second plurality of EON pins included in the second connector 410 can be mated with each of the corresponding EON pins 200. The mating could occur after the removal of the first connector body 400 from the PCB 403. Each EON pin of the first plurality of EON pins can include a first angled mating segment 261. The first angled mating segment could be mating with each of the corresponding EON pins 200. The mating of each of the corresponding EON pins 200 with each EON pin in the first plurality 240 could have been at a first mating location. In embodiments, the corresponding EON pins 200 could be mated with each of EON pin in the second plurality of EON pins 260 at a second mating location. The first mating location and the second mating location can be the same mating location relative to the PCB 403.

In embodiments, the first and second angled mating segments 241, 261 can be bent at ranges from thirty degrees to one hundred eighty degrees with respect to the first and second length segment, respectively. In some embodiments, the second plurality of EON pins 260 could be fabricated after examination. The rotation of the compliant segment of a second plurality of EON compliant pins with respect to a compliant segment of a first plurality of EON compliant pins could be determined after examination as well. Fabrication of a kit and the EON compliant pins that can include a rotation could be accomplished in various ways. The rotation may be provided by changing a stamp and form orientation within die operations. In embodiments, combination process options provide eye of needle orientation changes as well. For example, a combination process can include utilizing a stamp to initially fabricate a compliant segment that is rotated with respect to a first plurality of EON pins housed within a first connector body. In some embodiments, instruments with different compliant pin orientations can be made by making simple changes in a progressive die tooling used to stamp and form for a particular rotation.

In some embodiments, a rotation can be staged at a convenient point within progressive die stamping, bending, forming, and coining steps that can be used to fabricate an EON compliant pin. A kit that includes a connector and compliment connector can be assembled following fabrication of the EON compliant pins. The kit can be assembled in various versions. For example, a first version can include a connector and a compliment connector with EON pins with an angle of thirty degrees rotation relative to each corresponding pin in the other connector; a second version can include another connector and another compliment connector with EON pins with an angle of forty-five degrees rotation; and so on.

Figure 5:
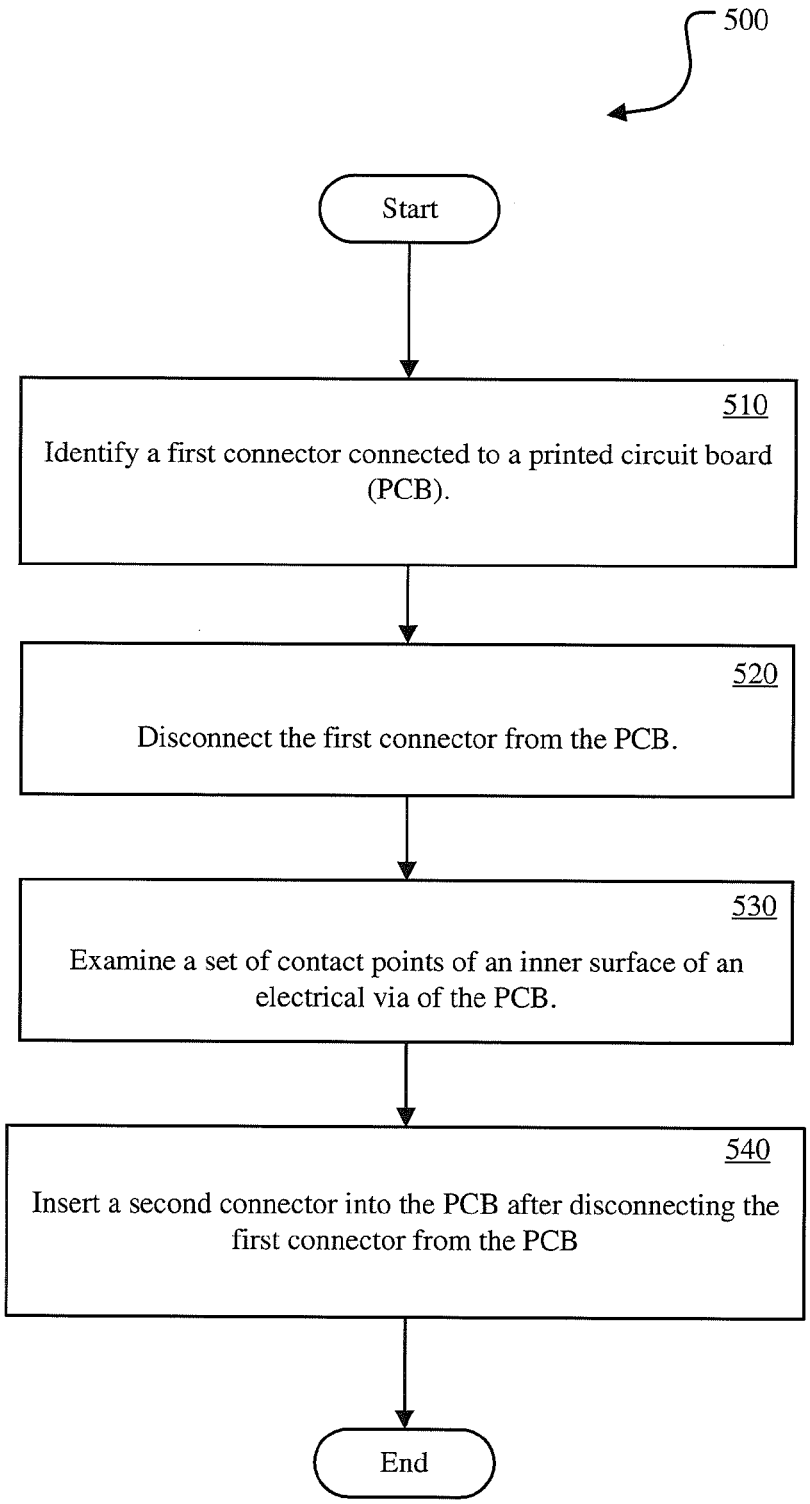
FIG. 5 depicts a method of reworking that includes disconnecting a first connector from a printed circuit board (PCB) and inserting a second connector into the PCB, according to embodiments of the present disclosure.

Now turning to FIG. 5, a method 500 for reworking can be seen, according to various embodiments. In embodiments, the method 500 can include, in operation 510, identifying a first connector, e.g. first connector 300, connected to a printed circuit board (PCB). The first connector can include a first plurality of male or female eye-of-needle (EON) compliant pins. The EON compliant pins can be composed of a conductive material, e.g. gold, silver, copper, or aluminum. In embodiments, the PCB can be an electronic circuit consisting of thin strips of a conducting material such as copper to which integrated circuits and other components can be attached. The PCB can be a part of a computer or electronic computing device. The first plurality of EON compliant pins can be connected to the PCB to maintain or redirect an electrical current. The first plurality of EON compliant pin cans include a header segment (male EON compliant pin) or a receptacle segment (female EON compliant pin). In embodiments, once operation 510 has identified the first connector, the method 500 can proceed to an operation 520.

In embodiments, operation 520 can include disconnecting the first connector from the PCB. Disconnecting can be accomplished by a human or a machine. Disconnecting the first connector may be due to routine maintenance. Routine maintenance may be caused by the PCB needing to be repaired, or as a result of the first connector having been damaged. The PCB may need to be repaired if electrical vias of the PCB are damaged from the EON compliant pins of the first connector exerting a normal force upon the electrical via's inner surface. The electrical via's inner surface can be damaged during removal of the first connector. An additional step can include removing a corresponding pin of a complimentary plurality of EON pins that could be mated to each EON pin in the plurality of EON pins. Each corresponding pin could be transferring an electrical current to an EON pin of the plurality of EON pins. Each corresponding pin could be connected to a logic board or to a computing device. Each corresponding pin could be a male or female EON pin. In embodiments, once operation 520 has disconnected the first connector from the PCB, the method 500 can proceed to an operation 530.

In embodiments, operation 530 can include examining a set of contact points of an inner surface of the electrical via of the PCB. The set of contact points can be from a pair of opposing spring arms of each of the EON compliant pins of the first plurality engaging the inner surface of the electrical via. Examining the set of contact points can be to determine a rotation for a second plurality of EON compliant pins of a second connector to insert into the PCB. The rotation of the second plurality of EON pins can be such that a second pair of each of the EON pins opposing spring arms can engage each of the electrical vias at a different set of contact points. Examining can increase the life of the electrical via, since repeated removal and insertion of EON compliant pins can cause electrical vias to crack. In embodiments, once operation 530 has examined the electrical vias, the method 500 can proceed to an operation 540.

In embodiments, the angle of rotation between a first normal, e.g. first normal 249, and a second normal, e.g. second normal 269, could be enough so that the second pair of opposing spring arms can engage the inner surface of the electrical via at a different set of contact points from the first set of contact points. In embodiments, the angle can be based on the examining of the electrical vias in operation 530. In embodiments, the angle can range from thirty degrees to one hundred fifty degrees.

In embodiments, the operation 540 can include inserting a second connector into the electrical via of the PCB. In embodiments, each of the second pair of opposing spring arms can engage the inner surface of the electrical vias at the different set of contact points. In embodiments, the method 500 can repeat more than once. The method 500 can repeat until opposing spring arms have engaged all contact points of the inner surface of the electrical via. For example, the method 500 can include a second connector that includes a second plurality of EON compliant pins that can include compliant segments at a thirty degree rotation relative to the corresponding complaint segments of the first plurality of EON compliant pins, and then repeat with a third connector that includes a third plurality of EON compliant pins that can include a rotation of sixty degrees, and so on.

In embodiments, the corresponding pins of the complimentary plurality of EON pins that were connected to and then removed from each of the EON pins of the first plurality of EON pins in the additional step could be connected to each EON pin of the second plurality of EON pins at a second location. The first location and the second location can be the same location relative to the PCB. Bent mating segment EON compliant pins that could be included within a second connector of a kit can be facing the same direction and occupying the same spatial orientation in order to maintain a same configuration as each EON pin in the first plurality maintained with each corresponding pin. This can be the case when each corresponding EON pin is attached to a computing device and the same configuration must be maintained. In other embodiments, once the second connector has been inserted into the electrical via in operation 540, the method 500 can conclude until a following reworking.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. A kit comprising:

a first connector including a first plurality of eye-of-needle (EON) pins inserted into a first connector body, each EON pin of the first plurality of EON pins having a compliant segment comprising two opposing spring arms and an opening defined between the spring arms, each compliant segment of the first plurality of EON pins being configured to be received within a corresponding electrical via of a printed circuit board (PCB) such that the spring arms of each EON pin of the first plurality of EON pins engage walls of the corresponding electrical via at a set of contact points; and a second connector including a second plurality of EON pins inserted into a second connector body, each EON pin of the second plurality of EON pins having a compliant segment comprising two opposing spring arms and an opening defined between the spring arms, each compliant segment of the second plurality of EON pins being configured to be received within a same corresponding electrical via of the PCB as a corresponding EON pin from the first plurality of EON pins located at a same relative connector body location such that the spring arms of each EON pin of the second plurality of EON pins engage the walls of the same corresponding electrical via at a different set of contact points.

2. The kit of claim 1, wherein each compliant segment of each EON pin of the first plurality of EON pins is turned at an angle with respect to a corresponding compliant segment of the corresponding EON pin of the second plurality of EON pins such that when the corresponding EON pin is inserted within the same corresponding electrical via, the different set of contact points is at a different location within the same corresponding electrical via than the set of contact points.

3. The kit of claim 2, wherein the angle is between 30 degrees and 150 degrees.

4. The kit of claim 1, wherein each EON pin of the first plurality and of the second plurality of EON pins further comprises a substantially straight mating segment, each mating segment configured to mate a corresponding mating segment.

5. The kit of claim 1, wherein each of the first plurality and of the second plurality of EON pins EON pin further comprises a substantially right angled mating segment, each mating segment including a pair of resiliently deflectable fingers that are spaced apart to define a mating slot of the mating segment.

6. A method comprising:

identifying a first connector connected to a printed circuit board (PCB), the first connector including a first plurality of eye-of-needle (EON) pins inserted into a first connector body, each EON pin of the first plurality of EON pins having a compliant segment comprising two opposing spring arms and an opening defined between the spring arms, each compliant segment of the first plurality of EON pins residing within a corresponding electrical via of the PCB such that the spring arms of each EON pin of the first plurality of EON pins are engaging walls of the corresponding electrical via at a set of contact points;

disconnecting the first connector from the PCB; and inserting a second connector into the PCB after disconnecting the first connector from the PCB, the second connector including a second plurality of EON pins inserted into a second connector body, each EON pin of the second plurality of EON pins having a compliant segment comprising two opposing spring arms and an opening defined between the spring arms, each compliant segment of the second plurality of EON pins being received within a same corresponding electrical via of the PCB as a corresponding EON pin from the first plurality of EON pins located at a same relative connector body location such that the spring arms of each EON pin of the second plurality of EON pins are engaging the walls of the same corresponding electrical via at a different set of contact points.

7. The method of claim 6, wherein each EON pin of the first plurality of EON pins includes a first angled mating segment, the first angled mating segment mated with a corresponding EON pin of a third plurality of EON pins at a first mating location, and wherein each EON pin of the second plurality of EON pins has a second angled mating segment, the method further comprising:

removing each corresponding EON pin from each of the EON pins of the plurality of EON pins; and mating the second angled mating segment with each corresponding EON pin of the third plurality of EON pins at a second mating location, wherein the first mating location and the second mating location are the same location relative to the PCB.

8. The method of claim 7, wherein the first angled mating segment is bent at a mating angle between thirty degrees and one hundred fifty degrees with respect to a first length segment of each EON pin of the first plurality of EON pins.

9. The method of claim 7, wherein the second angled mating segment is bent at a second mating angle between thirty degrees and one hundred fifty degrees with respect to a second length segment of each EON pin of the second plurality of EON pins.

10. The method of claim 7, wherein the angle is between 30 degrees and 150 degrees.

11. The method of claim 6, wherein each EON pin of the first plurality of EON pins is turned at an angle with respect to the corresponding EON pin of the second plurality of EON pins such that when the corresponding EON pin is inserted within the same corresponding electrical via, the different set of contact points is at a different location within the same corresponding electrical via than the set of contact points.

12. The method of claim 6, wherein each EON pin of the first plurality and of the second plurality of EON pins further comprises a substantially straight mating segment.

13. The method of claim 6, wherein each EON pin of the first plurality and of the second plurality of EON pins further comprises a substantially right angled mating segment, each mating segment including a pair of resiliently deflectable fingers that are spaced apart to define a mating slot of the mating segment.

* * * * *